US005721525A

United States Patent [19]

Hofsäss

[11] Patent Number: 5,721,525

[45] Date of Patent: Feb. 24, 1998

[54] TEMPERATURE CONTROLLER WITH BIMETALLIC SWITCHING DEVICES WHICH SWITCHES AT AN EXCESS TEMPERATURE

[76] Inventor: Marcel Hofsäss, Bodelschwinghstr. 36, D-75179 Pforzheim, Germany

[21] Appl. No.: 636,944

[22] Filed: Apr. 24, 1996

[30] Foreign Application Priority Data

Apr. 26, 1995 [DE] Germany ..... 195 14 853.3

[51] Int. Cl.[6] ..... H01C 7/13; H01H 37/00

[52] U.S. Cl. ..... 337/102; 337/107; 337/377; 337/380; 338/22 R

[58] Field of Search ..... 338/22 R; 337/102–107, 337/298, 333, 377, 380.3

[56] References Cited

U.S. PATENT DOCUMENTS

| | | | |
|---|---|---|---|
| 4,862,132 | 8/1989 | Hollweck | 337/102 |
| 4,878,038 | 10/1989 | Tsai | 337/107 |
| 5,233,325 | 8/1993 | Takeda | 337/107 |
| 5,309,131 | 5/1994 | Hofsass et al. | 337/102 |

FOREIGN PATENT DOCUMENTS

| | | |
|---|---|---|
| 0 284 916 A2 | 10/1988 | European Pat. Off. . |
| 2 121 802 | 1/1973 | Germany . |
| 41 42 716 A1 | 6/1993 | Germany . |
| 43 36 564 A1 | 5/1994 | Germany . |

*Primary Examiner*—Michael W. Phillips
*Assistant Examiner*—Jayprakash N. Gandhi
*Attorney, Agent, or Firm*—Harness, Dickey & Pierce, P.L.C.

[57] ABSTRACT

A temperature controller (10) having bimetallic switching device (15) which switches at an excess temperature and a heating resistor (23) in the same circuit as this which has the effect of a self-locking function. The heating resistor (23) is designed on a film (22) which is provided for thermal and/or electrical insulation.

12 Claims, 3 Drawing Sheets

TEMPERATURE CONTROLLER WITH BIMETALLIC SWITCHING DEVICES WHICH SWITCHES AT AN EXCESS TEMPERATURE

FIELD OF THE INVENTION

1. Background of the Invention

The present invention relates to a temperature controller with bimetallic switching device which switches at an excess temperature and a heating resistor in the same circuit as this which has the effect of a self-locking function.

2. Related Prior Art

Such a temperature controller is known, for example, from EP-A-0 284 916.

The known temperature controller comprises a housing containing the switching device which is closed by a cover of PTC material. The bimetallic switching device comprises in a known manner a bimetallic disk and a spring disk supporting a movable contact part. Below the response temperature of the bimetallic snap disk the spring disk presses the movable contact part against a fixed contact part in the cover, which protrudes through the cover in the manner of a rivet and ends in a head on the outside. The housing is made of electrically conductive material so that at low temperatures the switching device makes a conductive connection between the housing and the head of the fixed contact part. The cover has a conductive connection to both the fixed contact part and the housing so that it is connected electrically in parallel to the switching device.

If the switching device now opens as the result of overheating, the current flows from the fixed contact part through the PTC resistor formed by the cover to the housing so that the PTC resistor heats up and keeps the switching devices open, even when the excess temperature which has triggered the switching is no longer present. In this way the PTC resistor has a self-locking function.

In a further embodiment shown in this document the cover comprises a ceramic carrier part on which a carbon resistor is arranged which is responsible for the self-locking function in its function as heating resistor.

If the cover is made of PTC material it does not display the necessary stability under pressure which is often required in the everyday use of the known temperature controller. Such temperature controllers are namely used to monitor the temperature in motors, heating spirals, etc. whereby they are often subjected to high mechanical loads as a result of the vibrations associated with the operation of the electrical consumer which they are to protect. High pressures can also be exerted on the cover of the temperature controller.

If the parallel resistor is a carbon resistor, the cover itself can be made of a mechanically more stable material, though the temperature controller then displays other disadvantages. With carbon resistors in particular, the bimetallic switching device may suffer irreparable damage on account of excess temperatures of the carbon resistor. This is not possible with a PTC resistor as in parallel connected heating resistor since the temperature yield of the PTC resistor can be adjusted or adjusts itself on account of its temperature-dependent resistance value, which increases with a rising temperature, so that irreversible damage to the switching device due to excess temperatures in self-locking operation is avoided.

A further self-locking temperature controller is known from DE-A-43 36 564, where a second heating resistor is connected in series, ensuring that the known temperature controller is also sensitive to excess currents.

This known temperature controller comprises a ceramic carrier plate with a conductive or insulating coating on which an encapsulated bimetallic switching device is arranged, alongside which there is a PTC component connected in parallel to the switching device which is responsible for the self-locking function. The ceramic carrier plate also bears a thick-film resistor which passes below the switching device and which is connected in series with this.

The known temperature controller is connected in series with an electrical consumer to be protected so that the consumer's operating current flows through this. At the same time this temperature controller makes thermal contact with the consumer to be monitored in a known manner. If the consumer's operating current increases inadmissibly due to a defect the thick-film resistor connected in parallel heats up the switching device so that this opens, which means that the PTC resistor connected in parallel now guides the current. On account of the PTC resistor's high resistance the consumer's operating current is now reduced to a safe level, though this is still sufficient to maintain a temperature which opens the switching device via the ohmic power loss in the PTC resistor. It goes without saying that the known temperature controller also opens when the consumer overheats, so that the bimetallic switching device also opens and the PTC resistor takes over the current and maintains a temperature which keeps the temperature controller open.

The disadvantage of this temperature controller is that it is relatively bulky and large, due in particular to the ceramic carrier plate.

Further, a miniature self-locking temperature controller is known from DE-A-41 42 716 in which a heating resistor is connected in parallel and a further heating resistor is connected in series for monitoring the current. The protective resistor is an etched or punched part or a film printed with a resistor and is arranged in the direct vicinity of the spring disk of the bimetallic switching device, being in thermal and electrical contact with this, in such a way that it lies in the bottom half of the housing.

Apart from the complicated assembly of the known temperature controller, a further disadvantage is the fact that the etched or punched part used here as a heating resistor is not very accurate with respect to the resistance value and can only be made for a small resistance range. Moreover, an additional insulating component is also needed between the bottom of the housing and the heating resistor, and generally an additional, externally-mounted high-impedance resistor in series to the aforementioned protective resistor for reasons of resistance adjustment, which on the whole increase the costs of construction and overall dimensions.

SUMMARY OF THE INVENTION

In view of the state of the art it is an object of the present invention to improve a self-locking temperature controller of the kind mentioned at the outset such that the aforementioned disadvantages are overcome. In particular the new temperature controller should have a simple design, should be easy to install and generally inexpensive in its production.

This object is achieved by the invention in that the heating resistor is designed on a film which is preferably provided for thermal and/or electrical insulation.

The object underlying the invention is thus achieved in full. Since the heating resistor is now designed on a film it has small overall dimensions and can be easily mounted on various parts of the housing for the switching device. If the temperature controller is enclosed in a metal housing, the cover and housing base, for example, can be electrically insulated from one another by the film carrying the heating resistor. If, on the other hand, the temperature controller's housing is made of plastic or a similar electrically insulating material, the film is hereby responsible for the thermal insulation so that an adequate share of the heat which is generated can be saved, as it were, so as to maintain the self-locking function for at least a certain time. The film can, however, then also assume other functions, for example it can simultaneously serve as a protection against soiling or the like to insulate a new temperature controller which is used in rougher or dirtier surroundings against the infiltration of dirt particles which may affect its function.

In an embodiment it is then preferred if the temperature controller has a housing base to accommodate the switching device made of a conductive material, preferably metal, and a cover to close the housing base made of a conductive material, preferably metal, and if the film is at the same time responsible for the necessary insulation between the housing base and the cover.

The advantage of this is that the insulating film between the housing base and cover which is required in any case can simultaneously be designed as a film containing the heating resistor. Such temperature controllers with metal housing are known for example from DE-B-21 21 802. The contact for the known temperature controller is on the one hand via the cover and on the other via the housing base so that an insulating film between these two parts of the housing is necessary. The known temperature controller can thus be provided with a self-locking function in a surprisingly simple manner by way of the measure explained above, whereby the very reliable mechanical construction which withstands high pressures can be retained. A further advantage is that the construction and assembly as well as the devices provided for this purpose, e.g. handling equipment, etc. do not have to be altered, rather the film with the heating resistor in accordance with the invention only has to replace the insulating film previously used.

In an embodiment it is then preferred if the film is coated or printed with high-resistivity material on one or both sides, preferably resistor strips.

The advantage of this is that the resistance value can be adapted to the desired conditions by using film with high-resistivity material on either one or both sides. The resistance value can be further adjusted by the geometry of the resistor strips.

It is further preferred if the film comprises a high-resistivity material of a PTC material.

The advantage of this is that with the new heating resistor on the film the advantages of the PTC resistor mentioned at the outset can be implemented, in other words the protection against overheating through self-regulation.

It is hereby preferred if the film is through connected at least at one point so that the high-resistivity materials on both sides of the film are electrically connected.

The advantage of this is the simple contact to cover and housing base. The film represents two series-connected areas of high-resistivity material and/or conductive material which make contact with the housing base simply through its insertion. The cover is then placed on the film to make the second contact. The edges of the housing base are then normally beaded so that the cover is held firmly on the housing base. The heating resistor is now connected in parallel with the bimetallic switching device which, as mentioned at the outset, makes contact with the housing base through the spring disk on the one side and with the cover through the moveable contact part on the other when the switching device is closed.

It is furthermore preferred if the film is a heating film which displays an insulating plastic film with printed conductors which serve as heating resistors.

This measure is also preferred in view of a simple contact, the heating film is used in exactly the same way as the film described above as an insulating film. The printed conductors are hereby arranged so that they make contact with both the cover and housing base when the temperature controller is assembled normally.

It is furthermore preferred if the film is a posistor film, preferably a PTC film.

The advantage of this is that the film as a whole can be designed as a PTC resistor so that the contact with the cover and housing base can be realised very simply.

On the other hand it is preferred if the film is provided with high-resistivity material in certain areas.

The advantage of this is that the resistance value of the heating resistor can be set exactly through the choice of the size and possibly geometry of the high-resistivity material.

It is furthermore preferred if the film has high-resistivity material on one side and printed conductors for contact purposes on the other.

This is a further advantageous manner of ensuring a parallel connection of the heating resistor and bimetallic switching device without a short-circuit, similar to that of film between the cover and housing base for electrical insulation.

It is then generally preferred if the film is clamped between the housing base and cover, possibly with additional insulating material lying inbetween.

The advantage of this is that the new temperature controller is not only easy to assemble, but also a short-circuit can be simply avoided and contact made with the heating resistor.

Further advantages can be derived from the description and enclosed drawing.

It is understood that the aforementioned features and those to be explained in the following can be used not only in the specified combinations but also in other combinations or alone without going beyond the scope of the present invention.

BRIEF DESCRIPTION OF THE DRAWINGS

The invention is shown in the drawings and will be explained in more detail in the following description.

DETAILED DESCRIPTION OF A PREFERRED EMBODIMENT

Figure 1:
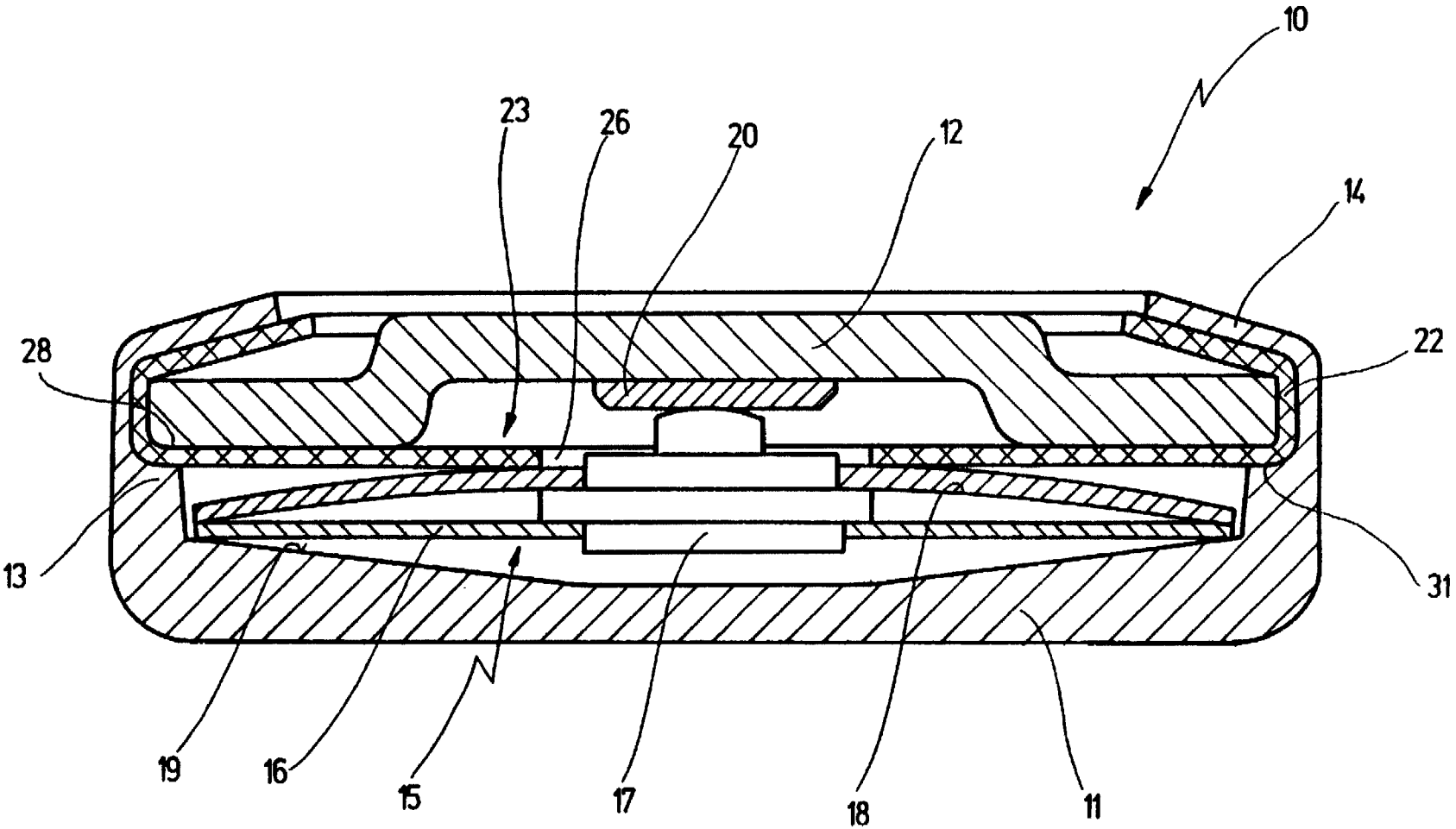
FIG. 1 is a new temperature controller in a sectional side view in which the insulating film is designed as a heating resistor, though this is not shown here for reasons of clarity.

FIG. 1 shows an axial section of an embodiment of the new temperature controller 10. The temperature controller 10 comprises a pot-shaped housing base 11 and a cover 12 which closes the housing base 11 and which rests on a circumferential shoulder 13 of the housing part 11. The temperature controller 10 is closed by a beaded edge 14 of the housing base 11 which presses the cover 12 onto the circumferential shoulder 13.

Inside the housing base 11 there is a bimetallic switching device 15 of a common construction. This comprises a spring disk 16 bearing a moveable contact part 17 over which a bimetallic snap disk 18 is placed. The spring disk 16 rests on the bottom of the pot-shaped housing base 11 and thus clamps the moveable contact part against a fixed contact part 20 provided on the inside of the cover 12.

In this temperature controller 10 the housing base 11 and cover 12 are made of a conductive material, preferably metal so that an insulating film 22 is provided which insulates the cover 12 from the housing base 11. Contact for the temperature controller 10 is made on the one hand via the cover 12 and on the other via the housing base 11, as is already known.

In the switching state shown in FIG. 1 the switching device 15 displays a temperature below that of its response temperature so that it is closed, thus ensuring a conductive connection between the fixed contact part 20, and thus the cover 12, and the base 19, and thus the housing base 11.

If the temperature of the switching device 15 is now increased the bimetallic snap disk 18 suddenly snaps over from the convex form shown here into a concave and comes to rests on the base of the cover 12 in such a way that the moveable contact part is raised from the fixed contact part 20 against the force of the spring disk 18.

In this respect the construction of the new temperature controller 10 is known, displaying a high stability under pressure thanks to its metal housing.

In accordance with the invention the insulating film 22 has a heating resistor 23, not shown in FIG. 1 for reasons of clarity, which is connected in parallel to the bimetallic switching device 15 in a manner to be described later. As long as the bimetallic switching device 15 is in the closed position shown in FIG. 1, the heating resistor 23 is bridged and has no effect. However, when the bimetallic switching device opens on account of a rise in temperature part of the current which previously flowed through the temperature controller 10 now flows through the heating resistor 23 so that this heats up to such an extent that a temperature is created inside the temperature controller 10 which is sufficient to maintain the switching device 15 in an open state for at least a little while even after the outside excess temperature which has caused the switchover drops again. The insulating film 22 can hereby be designed in such a way that it prevents an excessively fast loss of heat from the inside of the temperature controller 10. For example, the housing base 11 and cover 12 may be made of plastic or a similar non-conducting material so that the insulating film 22 as such is not required for the function. It goes without saying that in such cases the fixed contact part 20, for example, is through connected in the manner of a rivet whereas on the other hand an electrical contact is made to the outside via the base 19. This alternative is not shown in further detail in FIG. 1 for reasons of clarity.

Although, as already mentioned, the insulating film 22 does not have to be provided for reasons of electrical insulation, it has the advantage that it provides a further thermal insulation of the inside of the temperature controller 10 so that temperature inside the temperature controller 10 does not drop too quickly. The heating resistor 23 can be designed in this case in such a way that it cannot maintain the necessary temperature inside the temperature controller 10 over a longer period of time alone, though it can help prevent this temperature dropping too quickly to ensure the desired rise-delay time. It goes without saying that this additional function of the thermal insulation can be performed by the insulating film 22 even when the cover 12 and housing base 11 are made of metal.

In both of the embodiments explained above the insulating film 22 thus has two functions; on the one hand is provides an electrical and/or thermal insulation and on the other it bears the heating resistor 23 which is responsible for or assists the self-locking function.

A special advantage of the new temperature controller 10 is in the fact that the known construction, which already uses an insulating film as electrical insulation for the reasons mentioned above, can be fully retained, the insulating film 22 only has to be additionally provided with a heating resistor 23. However, this means that in the normal manufacturing process the purely insulating film used previously only has to be exchanged for an insulating film bearing the heating resistor in accordance with the invention so that there are no set-up costs whatsoever for the production equipment. The new temperature controller 10 displays all the known and desired mechanical and electrical features already introduced onto the market and is provided with an additional self-locking function in this extremely simple manner.

Figure 2:
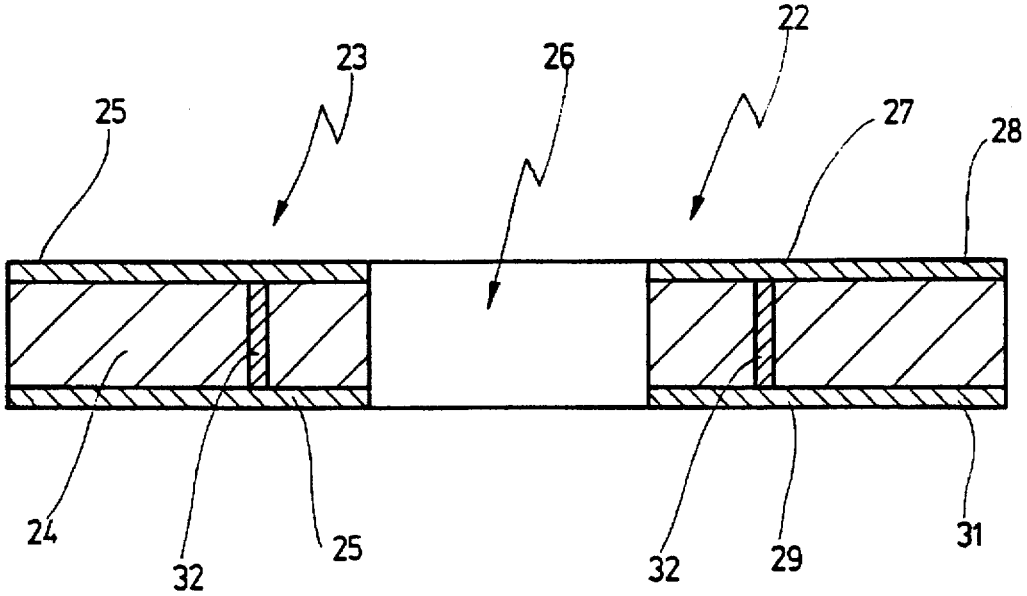
FIG. 2 is an insulating film suitable for installation in the temperature controller from FIG. 1 before installation, enlarged and not to scale.
Figure 3:
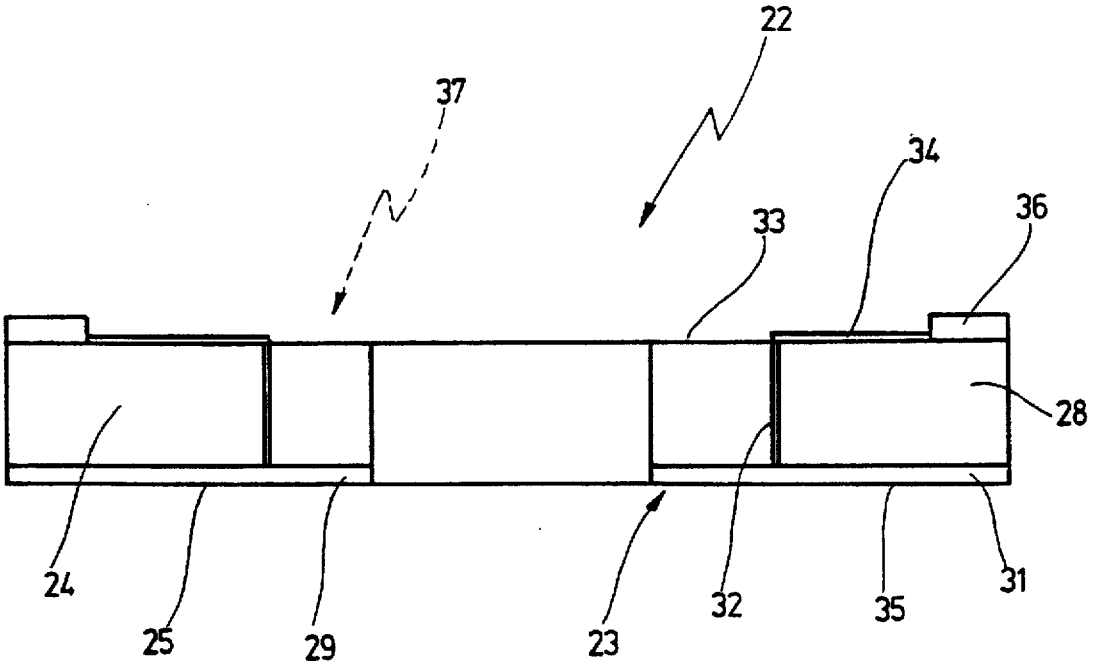
FIG. 3 is a further embodiment of an insulating film with heating resistor in a representation as shown in FIG. 2.
Figure 4:
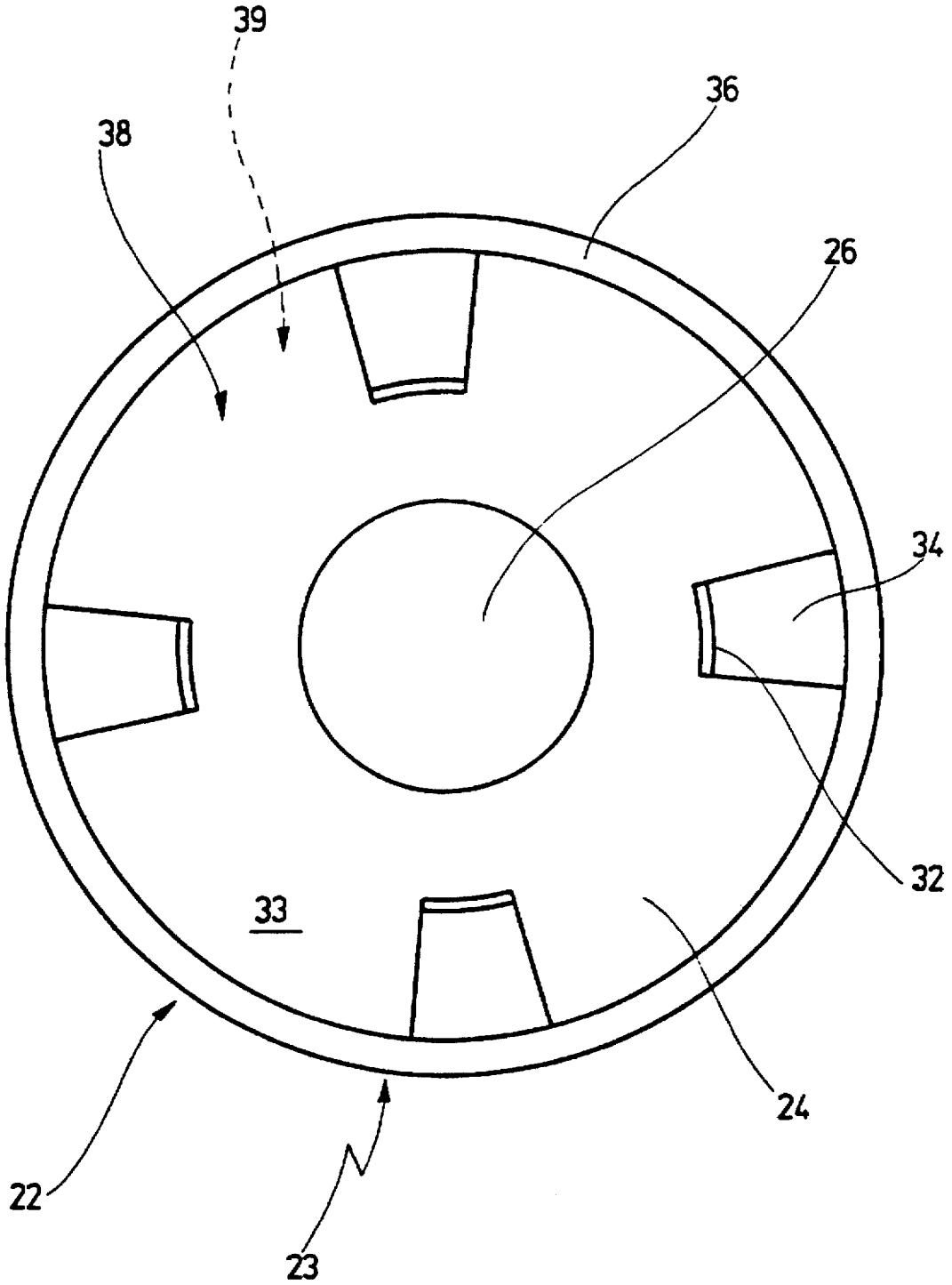
FIG. 4 is a top view of the insulating film from FIG. 3

We will now explain how this heating resistor 23 is provided on the insulating film 22 using the examples shown in FIGS. 2 to 4.

FIG. 2 shows an enlarged and not true-to-scale cross-section of an insulating film 22 such as is used in the temperature controller shown in FIG. 1.

The insulating film 22 displays a film 24 as carrier material, e.g. of Teflon, Kapton, Nomex or a similar material. The film 24 has high-resistivity material 25 on both sides which can be, for example, a PTC material, carbon film resistor or similar. An opening 26 is provided in the film 24 in a known manner which is placed over the moveable contact part 17, as can be seen in FIG. 1.

The edge 28 of the insulating film 22 makes contact with the cover 12 via its upper high-resistivity material 27 when installed whereas it makes electrical contact with the housing base 11 via its lower high-resistivity material 29, whose edge 31 rests on the shoulder 13 of the housing base 12.

Since the film 24 itself is insulating in the embodiment shown, throughplatings 32 are provided which connect the upper high-resistivity material 27 to the lower high-resistivity material 29. In this way the heating resistor 23 formed by the upper and lower high-resistivity material 27 and 29 makes contact on the one side with the cover 12 and on the other with the housing base 11 so that it is connected in parallel to the bimetallic switching device 15. In this way the heating resistor 23 can ensure the self-locking function of the temperature controller 10 as already discussed in more detail above.

The resistance value can also be adjusted by the gap between the throughplatings 32 and outer edges 28, 31, namely the closer these throughplatings are to the edges 28, 31, the lower the series connection from the two resistance areas, assuming that the other geometric and electrical properties are not changed.

If the film 24 is to be conductive or display a certain resistance itself, the throughplatings 32 can be dispensed with provided the resistance value measured between the upper high-resistivity material 27 and the lower high-resistivity material 29 in an axial direction is large enough to achieve the desired heating function when the bimetallic switching device is open. When the bimetallic switching device 15 is closed the heating resistor 23 is in any case bridged by the latter so that its resistance value does not affect the function of the temperature controller 10.

In an embodiment not shown in FIG. 2 the film 24 itself can be a PTC film 24' so that the upper and lower high-resistivity material 27, 29 as well as throughplatings 32 can be dispensed with completely.

FIG. 3 shows a further embodiment of the new insulating film 22 such as can be used in the temperature controller shown in FIG. 1.

The film 24 here displays printed conductors 34 on its upper surface 33 which are connected to the lower high-resistivity material 29 on its underside 35 by the throughplatings 32. The printed conductors 34 are ideally arranged radially on the upper surface 33 and end in a preferably circular printed conductor 36 in the area of the edge 28. In this insulating film 22 the heating resistor 23 is essentially formed by the lower high-resistivity material 29; the printed conductors 34, 36 and the throughplatings 32 only serve for an electrical contact between the lower high-resistivity material 29 and the cover 12. At the edge 31 the lower high-resistivity material 29 again rests on the shoulder 13 so that here too the heating resistor 23 is connected in parallel to the bimetallic switching device 15.

In a variant of the embodiment shown in FIG. 3 the printed conductors 32, 34, 36 can also be strips of resistant material arranged on both the upper 33 and lower 35 side. In this case the heating resistor 23 is only formed by the resistance values of the strip resistors 32, 34, 36. In such a case one speaks of a heating film 37, whereby an insulating film 24 is provided with printed resistors 32, 34, 36.

FIG. 4 shows a top view of the insulating film 22 from FIG. 3 in which it can be seen that the strip resistors 34, 36 only cover parts of the film 24 whereby the extent of the coverage, in other words the selected geometry, determines the resistance value of the heating resistor 23.

It goes without saying that in a variation of the embodiment in accordance with FIG. 4 the insulating film 22 can display strip resistors 34, 36 on both its upper surface 33 and underside 35, as shown in FIG. 4.

The film can in general be made of a posistor material which unspecifically displays a positive coefficient of temperature. However, it is also possible to use a PTC film with exactly adjustable temperature-dependent resistance behaviour as a film 22, 24.

If the film is made of conductive material 24 and the strip conductors or resistors 32, 34, 36 are responsible for the resistance value of the heating resistor 23 it may be necessary to provide a liner of further insulating material 39 in the free space between the strip conductors 34 which ensures a partial insulation to the housing base 11 or cover 12 on both sides of the insulating film 24 and which insulates the bimetallic disk 18 from the heating resistor 23 when the switching device 15 switches.

What I claim is:

1. A temperature controller, comprising:

a housing base made of a conductive material, said housing base having an open end;

a cover made of conductive material provided for closing said open end in said housing base;

a bimetallic switching device disposed between said housing base and said cover wherein said bimetallic switching device switches at an excess temperature; and a film disposed between said housing base and said cover for generally providing electrical insulation between said housing base and said cover, wherein a heating resistor is provided on said film for providing a self-locking function.

2. The temperature controller in accordance with claim 1, wherein said housing base and said cover are made of a metal.

3. The temperature controller in accordance with claim 2, wherein the film is coated or printed with high-resistivity material.

4. The temperature controller in accordance with claim 1, wherein the film is provided with high resistivity material on both sides.

5. The temperature controller in accordance with claim 4, wherein the film is through connected at least at one point so that the high-resistivity materials on both sides of the film are electrically connected with each other.

6. The temperature controller in accordance with claim 1, wherein the film comprises a high-resistivity material of a PTC material.

7. The temperature controller in accordance with claim 1, wherein the film is a heating film which comprises an insulating plastic film with printed conductors which serve as heating resistors.

8. The temperature controller in accordance with claim 1, wherein the film is a posistor film.

9. The temperature controller in accordance with claim 8, wherein said posistor film is a PTC film.

10. The temperature controller in accordance with claim 1, wherein the film is provided with high-resistivity material.

11. The temperature controller in accordance with claim 1, wherein the film has high-resistivity material on one side and printed conductors for contact purposes on the other.

12. The temperature controller in accordance with claim 1, wherein the film is clamped between the housing base and cover with an underlining of additional insulating material.

* * * * *